US006245146B1

(12) United States Patent
Weitmann et al.

(10) Patent No.: US 6,245,146 B1
(45) Date of Patent: Jun. 12, 2001

(54) DEVICE FOR COVERING TRANSPORTED PRINTED SHEETS WITH POWDER

(75) Inventors: Carlheinz Weitmann, Leonberg; Marcel Konrad, Leinfelden-Echterdingen, both of (DE)

(73) Assignee: Weitman & Konrad GmbH & Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 09/435,350

(22) Filed: Nov. 8, 1999

(30) Foreign Application Priority Data

Dec. 18, 1998 (DE) ..... 198 58 484

(51) Int. Cl.[7] ..... B05C 5/00
(52) U.S. Cl. ..... 118/312; 118/308; 118/309
(58) Field of Search ..... 118/308, 309, 118/312, 236, 620, 621, 50.1, DIG. 5

(56) References Cited

U.S. PATENT DOCUMENTS 5,225,655 * 7/1993 Muehlberger ..... 219/121.47

FOREIGN PATENT DOCUMENTS 966 443 * 7/1957 (DE) .
969 862 * 7/1958 (DE) .
12 52 703 * 5/1968 (DE) .
297 17 645 * 1/1998 (DE) .

* cited by examiner

*Primary Examiner*—Richard Crispino
*Assistant Examiner*—Yewebdar T Tadesse
(74) *Attorney, Agent, or Firm*—Paul Vincent

(57) ABSTRACT

The invention concerns a device for covering printed sheets with powder having a reservoir for the powder, an inlet for a carrier air stream feeding into the reservoir, an outlet for the carrier air stream loaded with powder exiting out of the reservoir and with a heating cartridge disposed in the reservoir, wherein the heating cartridge is provided with a heat conducting device. Powder can thereby be heated in a controlled, simple, and effective manner to remain in a pourable condition.

9 Claims, 2 Drawing Sheets

DEVICE FOR COVERING TRANSPORTED PRINTED SHEETS WITH POWDER

This application claims Paris Convention priority of DE 198 58 484.9 filed Dec. 18, 1998 the complete disclosure of which is hereby incorporated by reference.

BACKGROUND OF THE INVENTION

The invention concerns a device for covering transported printed sheets with powder having a reservoir for powder, an inlet feeding into the reservoir for a carrier air stream, an outlet feeding out of the reservoir for the carrier air stream containing powder and with a heating cartridge disposed in the reservoir.

Known in the art from DE-AS 1 252 703 and DE-PS 966 443 is e.g. a device for covering printed sheets with powder with which a carrier air stream is blown into a reservoir filled with powder so that this carrier air stream whirls up the powder contained therein. The air stream containing powder is guided from an outlet to the printed sheet which is to be covered with powder, via appropriate conduits. It has turned out that, although printed sheets can be covered with powder using a device of this kind, the quality of the covering depends strongly on the state of the powder in the powder reservoir. In the event of relatively high air moisture, there is the danger that the powder forms clumps in the powder reservoir and cannot properly be whirled-up. A reduced amount of powder is thereby carried out along with the carrier air stream so that the covering is insufficient. Although powder reservoirs of this type are equipped with a heating cartridge for introducing heat into the powder, this heat introduction is locally limited. Clumping of the powder cannot thereby be avoided.

It is therefore the underlying purpose of the invention to further improve a device of the above mentioned kind to prevent clumping to the greatest extent possible.

SUMMARY OF THE INVENTION

This purpose is achieved in accordance with the invention with a device of the above mentioned kind in that the heating cartridge is provided with a heat conducting device.

This heat conducting device distributes the heat over an increased surface and introduces it into the powder over an increased area. In this manner, one avoids a merely local heating of the powder. The heat conducting device has the additional advantage that larger amounts of energy can be introduced into the powder. A further advantage of the invention is that the heat conducting device can be used to introduce the heat into defined regions in which the powder tends to build clumps or to bake together. These endangered regions can be located at a separation relative to the heating cartridge and this separation can be bridged by the heat conducting device. In particular, the heat conducting device can be used to introduce heat into regions where e.g. it is not possible to dispose a heating cartridge for structural reasons.

In accordance with a preferred embodiment, the heat conducting device is configured as a heat conducting sheet. A heat conducting sheet has the substantial advantage of having relatively low mass and a very large surface area and can thereby dispense relatively large amounts of heat. The sheet occupies only a small amount of space in the reservoir due to its relatively small thickness.

In order to obtain optimal heat transfer from the heat conducting device to the powder, the heat conducting device is at least partially or sectionally surrounded by powder.

Heat transfer thereby occurs not only via radiant heat but also through direct heat transfer to the powder adjacent to the heat conducting device.

Optimal use of storage volume in the reservoir is achieved when the heat conducting sheet extends up to the floor and/or up to one side wall or up to the side walls of the reservoir. As large a surface as possible is thereby created by means of which the heat conducting sheet can release heat.

In order to avoid the creation of regions within the reservoir from which powder can be removed but to which no powder can flow, the heat conducting device has one or more openings for connecting the individual regions within the reservoir to each other to permit powder exchange.

In order to adjust the heat transfer in an optimal fashion to the respective requirements within the reservoir, the heat conducting device has a non-planar shape and is, in particular curved or folded, e.g. in an accordion-like fashion. In this manner, the heat can be introduced to problem zones in a directed fashion.

An improvement provides that the heat conducting device is connected to the heating cartridge in a detachable fashion. Towards this end, the heat conducting device has mounting elements, e.g. clamp straps, screw straps, mounting tabs or the like by means of which it is either attached to the reservoir or to a holding device for the reservoir. The heat conducting device is advantageously firmly fixed to the heating cartridge. This has the additional substantial advantage that the heat can be optimally transferred from the heating cartridge to the heat conducting device due to the mounting of the heat conducting device to the heating cartridge.

Additional advantages, features and details of the invention can be derived from the subsequent description in which two particularly preferred embodiments are described in detail with reference to the drawing. The features represented in the drawing, the claims, and the description can thereby be important to the invention either individually or collectively in arbitrary combination.

DESCRIPTION OF THE PREFERRED EMBODIMENT

Figure 1:
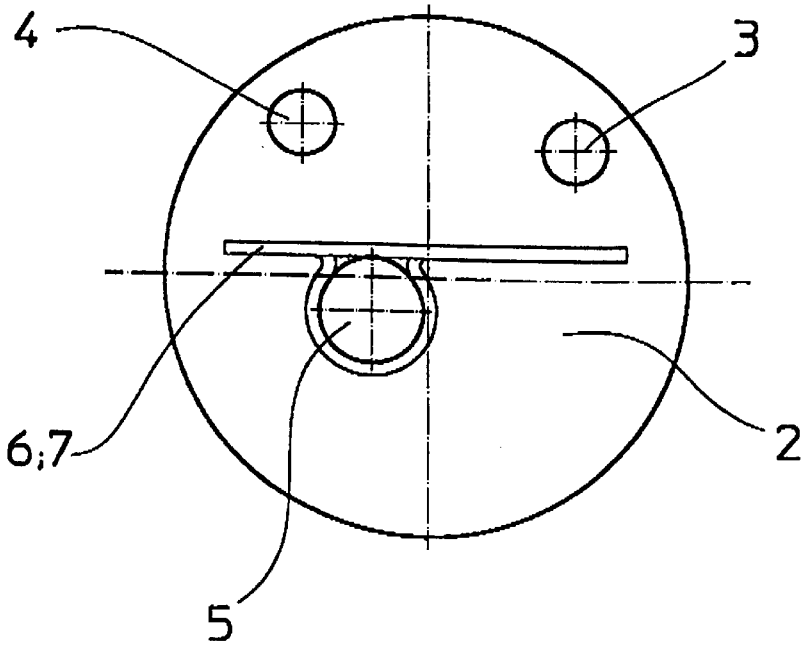
FIG. 1: shows a cut I—I in accordance with FIG. 2 through a reservoir having a heating cartridge disposed in the reservoir and a heat conducting sheet mounted thereto.
Figure 2:
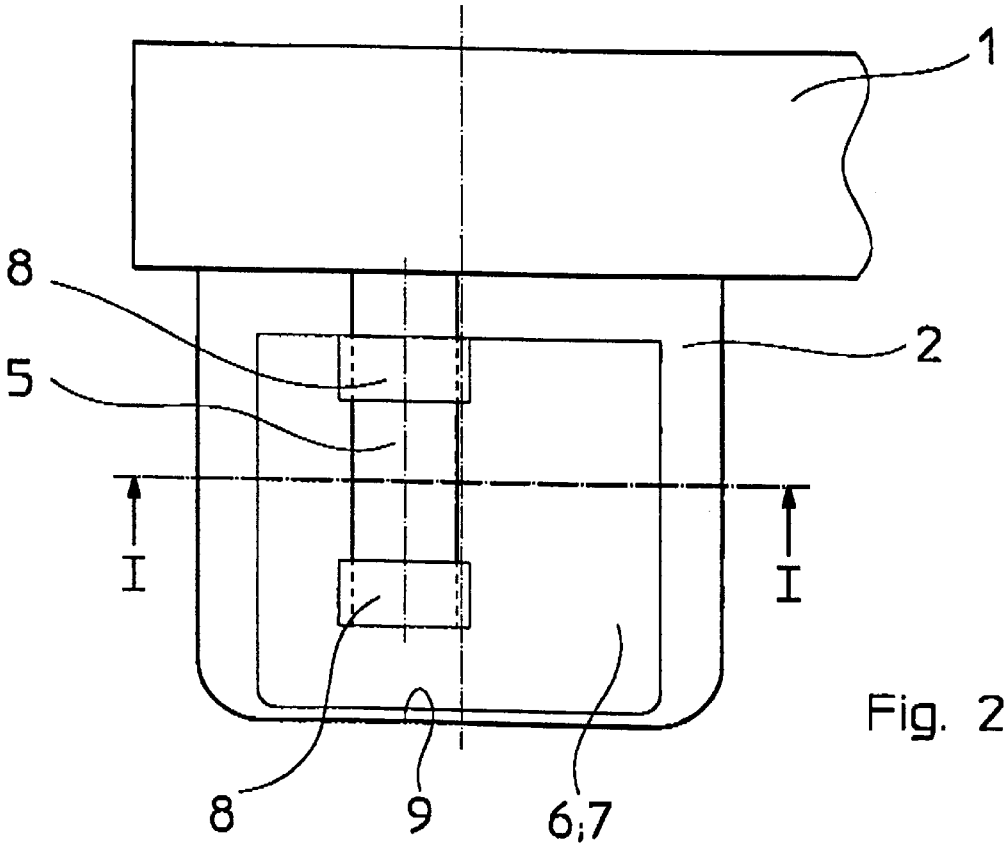
FIG. 2: shows a side view of the reservoir in accordance with FIG. 1.

A first embodiment of the device in accordance with the invention is shown in FIGS. 1 and 2, wherein a reservoir 2 is mounted to a holding device designated in its entirety with 1. A carrier air stream is blown via an inlet 3 onto powder (not shown) located in this reservoir 2 to whirl-up the powder in the reservoir. The carrier air stream bearing powder escapes via an outlet 4 out of the reservoir 2 to thereby remove powder therefrom. In addition, a heating cartridge 5 projects into the reservoir 2, protruding in a downward direction from the holding device 1. The heating cartridge 5 has a cylindrical shape. Other shapes are however conceivable.

A heat conducting sheet 7 configured as a heat conducting device 6 is attached to the heating cartridge 5. Towards this end, the heat conducting sheet 7 has tabs 8 which loop around the heating cartridge 5. The heat conducting sheet 7 is thereby positively or frictionally connected to the heating cartridge 5. As can be seen in FIG. 2, the heat conducting sheet 7 extends up to the region of a floor 9 of the reservoir 2 and can even come in contact therewith.

Clearly, the heat conducting sheet 7 improves transfer of the heat energy of the heating cartridge 5 into the powder provided in the reservoir 2.

Figure 3:
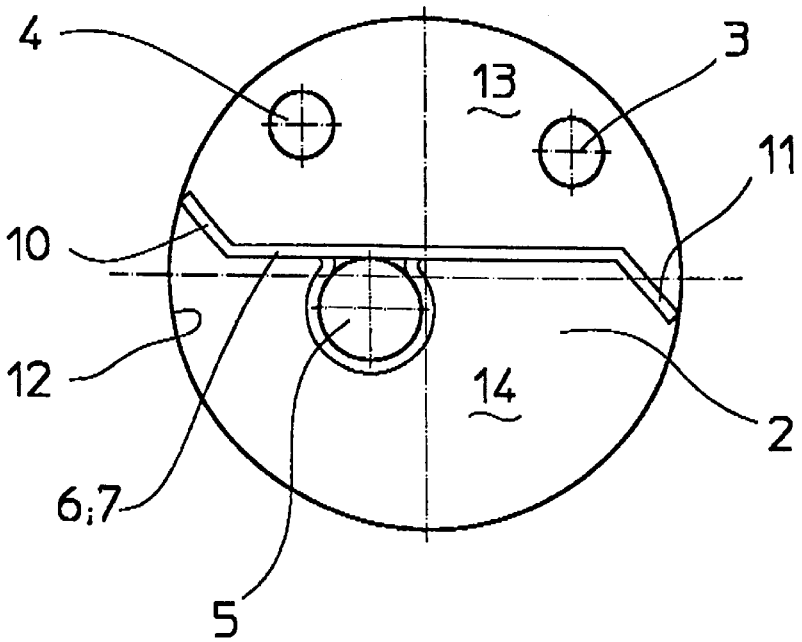
FIG. 3: shows a section III—III in accordance with FIG. 4 through a reservoir having a heated cartridge disposed in the reservoir and a heat conducting sheet attached thereto in accordance with a second embodiment.
Figure 4:
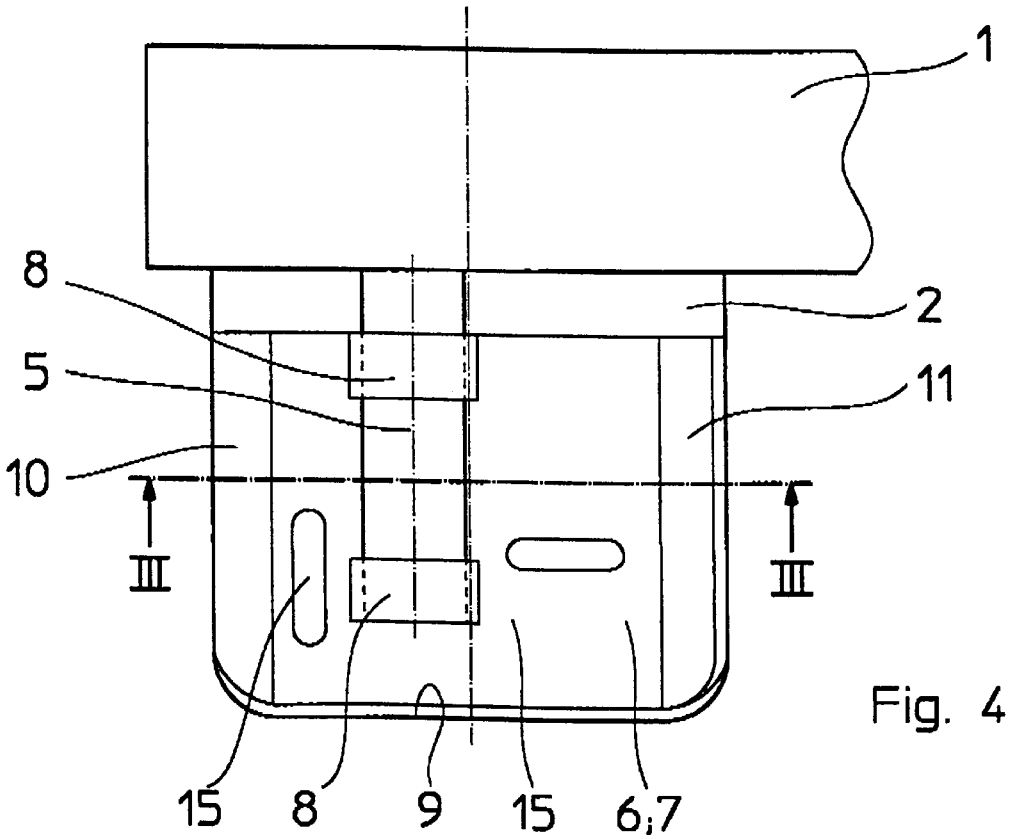
FIG. 4: shows a side view of the reservoir in accordance with FIG. 3.

In the embodiment in accordance with FIGS. 3 and 4, the holding device 1 and the reservoir 2 are of similar structure, however the heat conducting sheet 7 has bent sideward ends 10 and 11. These ends 10 and 11 extend up to the side wall 10 of the reservoir 2 and subdivide same substantially into two regions 13 and 14. The heat conducting sheet 7 has openings 15 in order to guarantee an exchange of powder between the regions 13 and 14. These openings 15 can be provided in the heat conducting sheet 7 in differing regions, with differing shapes, in differing numbers, and at differing heights.

In this embodiment, the introduction of heat into the powder is further improved by enlarging the surface of the heat conducting sheet 7. The heat can be directed to problem zones in a defined fashion using the bent regions.

We claim:

1. A device for covering transported printed sheets with powder via a carrier air stream, the device comprising:

a reservoir for containing the powder, said reservoir having an inlet for feeding the carrier air stream to the powder and an outlet for passing the carrier air stream, loaded with powder, out of said reservoir;

a heating cartridge disposed within said reservoir; and a heat conducting device disposed within said reservoir in thermal communication with said heating cartridge and in thermal communication with the powder to pass heat from said heating cartridge into the powder, wherein said heat conducting device has at least one of a shape deviating from planar, a bent shape, and a folded-over shape.

2. The device of claim 1, wherein said heat conducting device is at least partially surrounded by powder.

3. The device of claim 1, wherein said heat conducting device extends up to a floor of said reservoir.

4. The device of claim 1, wherein said heat conducting device extends up to at least one side wall of said reservoir.

5. The device of claim 1, wherein said heat conducting device has at least one opening.

6. The device of claim 1, further comprising means to connect said heat conducting device to said heating cartridge in a detachable fashion.

7. The device of claim 1, further comprising means for fixing said heat conducting device to said heating cartridge in a rigid fashion.

8. The device of claim 1, wherein said heat conducting device comprises a heat conducting sheet.

9. The device of claim 1, wherein said heat conducting device consists essentially of metal.

* * * * *